US005636184A

United States Patent [19]

Boyd

[11] Patent Number: 5,636,184

[45] Date of Patent: Jun. 3, 1997

[54] SWITCH FOR RESETTING AN ANALOG CLOCK HOUR HAND

[76] Inventor: Daniel C. Boyd, 113 Grayland Hills Ct., Lawrenceville, Ga. 30245

[21] Appl. No.: 642,908

[22] Filed: May 6, 1996

[51] Int. Cl.[6] ..... G04B 19/22; G04B 19/04; G04B 18/00

[52] U.S. Cl. ..... 368/22; 268/80; 268/185

[58] Field of Search ..... 368/21, 22, 69–70, 368/80, 185, 190–195

[56] References Cited

U.S. PATENT DOCUMENTS

| | | | |
|---|---|---|---|
| 2,461,599 | 2/1949 | Graef | 368/22 |
| 2,777,281 | 1/1957 | Berry | 368/22 |
| 3,407,591 | 10/1968 | McMahill | 368/22 |
| 3,695,035 | 10/1972 | Cleusix | 368/22 |
| 4,254,493 | 3/1981 | Billet . | |
| 4,415,272 | 11/1983 | Heinzelmann | 368/69 |
| 4,422,777 | 12/1983 | Nakamura | 368/185 |
| 4,956,826 | 9/1990 | Coyman et al. . | |
| 5,210,721 | 5/1993 | Kikuchi . | |
| 5,285,427 | 2/1994 | Vaucher . | |
| 5,383,165 | 1/1995 | Vaucher . | |

*Primary Examiner*—Vit W. Miska
*Attorney, Agent, or Firm*—Hinkle & Associates, P.C.

[57] ABSTRACT

The timepiece has a gear housing containing a horometric movement and a minute hand gear 12 operatively connected to the movement. Also, the timepiece comprises a drive gear 2 operatively connected to the movement, a cylinder gear 4 engaging the drive gear 2 by crown teeth 24 disposed on both gears 2 and 4, a leaf spring 6 biasing the cylinder gear 4 against the drive gear 2, a rod 8 and a sliding switch 10 pivotally disposed on the rod 8. The sliding switch 10 has a switch tooth 68 that removably engages the cylinder gear 4, forcing the crown teeth 24 to slide into an adjacent position which independently moves an hour hand 54. Other embodiments employ a spindle switch 78 and a pop-up switch 88.

15 Claims, 4 Drawing Sheets

SWITCH FOR RESETTING AN ANALOG CLOCK HOUR HAND

BACKGROUND OF THE INVENTION

I. Field of the Invention

The present invention relates generally to the field of time measurement devices. More particularly, the present invention relates to an analog timepiece having an independent hour hand adjustment switch.

II. Description of the Related Art

In most states of the United States, clocks must be reset twice per year to accommodate daylight savings time. With typical analog clocks the individual must turn a single knob that not only moves an hour hand, it also inconveniently moves a minute hand. Requiring the individual to remember the exact minute at the moment of correction activity is significant inconvenience. Further, this type of clock generally has the knob in the rear of the clock, requiring the individual to handle or remove clocks which are mounted on walls. It is desirable to be able to change the hour indicated by the hour hand without disturbing the position of the minute hand or affecting the timekeeping of the clock.

Others have devised analog clocks to assist the individual in changing the hour indication without moving the minute and, if provided, a second hand. However, these clocks have complicated mechanisms and are not readily adaptable to existing clocks.

A watch described in U.S. Pat. No. 4,254,403 by Billet has an epicyclic speed reduction gearing to drive an hour hand from the minute hand. The watch has an epicyclic gear train which drives an hour hand spindle, a selectively rotatable hour setting wheel, and guiding means operatively connected between portions of the epicyclic gear train and the setting wheel. Although this complicated arrangement is capable of moving the hour hand alone, the individual is responsible for locating the hour hand placement to be in proper relation to the minute hand.

U.S. Pat. No. 5,210,721 granted to Kikuchi describes an analog universal watch has a pawl fastened to an hour wheel which engages with a ratchet wheel fastened to an area dial spindle so that an hour hand spindle is driven indirectly. An hour hand correcting wheel engages with and releases a hand setting stem to set the hour hand alone to the desire time. This device is also complicated with multiple gearing arrangement, and is not readily adaptable to existing clocks.

A timepiece described in U.S. Pat. No. 5,383,156 by Vaucher has a first and a second toothed wheel coaxially mounted on an hours pipe, a jumping device coupling the first and second wheels and a star gear intermediate the first wheel and a ring for permitting the wheel to drive the ring. The first wheel is in gear with the dial train, and is mounted to rotate freely on the hours pipe. The second wheel is secured to the hours pipe for rotation and has a means for permitting the second wheel to be operated by the stem for correcting the position of the hours hand without rotating the ring. As with the other mentioned devices, the gearing structure is complicated and is not readily adaptable to existing clocks.

SUMMARY OF THE INVENTION

In accordance with the present invention, it is contemplated that problems which have and continue to exist in this field, the objectives of this invention are to provide:

an analog timepiece having an independent hour hand adjustment switch;

a drive gear and a cylinder gear which can replace an existing conventional hour hand cylinder gear;

a timepiece that adjusts one-hour without affecting the minute or second hands by activating a switch; and a timepiece that adjusts one-hour without requiring an operator to watch the hour hand.

This invention accomplishes the above and other objectives and overcomes the disadvantages of the prior art by providing an analog timepiece having an hour hand adjustment switch that is simple in design and construction, inexpensive to fabricate, and easy to use. The timepiece has a gear housing containing a horometric movement and a minute hand gear operatively connected to the movement. Also, the timepiece comprises a drive gear operatively connected to the movement, a cylinder gear engaging the drive gear by equidistantly spaced crown teeth matingly disposed on each of the drive gear and the cylinder gear, a leaf spring 6 biasing the cylinder gear in contact with the drive gear, a rod and a sliding switch pivotally disposed on the rod. The sliding switch has a switch tooth that removably engages the cylinder gear, forcing the crown teeth to slide into an adjacent position which independently moves an hour hand. Other embodiments employ a spindle switch and a pop-up switch in place of the sliding switch.

It is to be understood that the phraseology and terminology employed herein are for the purpose of description and should not be regarded as limiting. As such, those skilled in the art will appreciate that the conception, upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

DESCRIPTION OF THE PREFERRED EMBODIMENTS

Figure 1B:
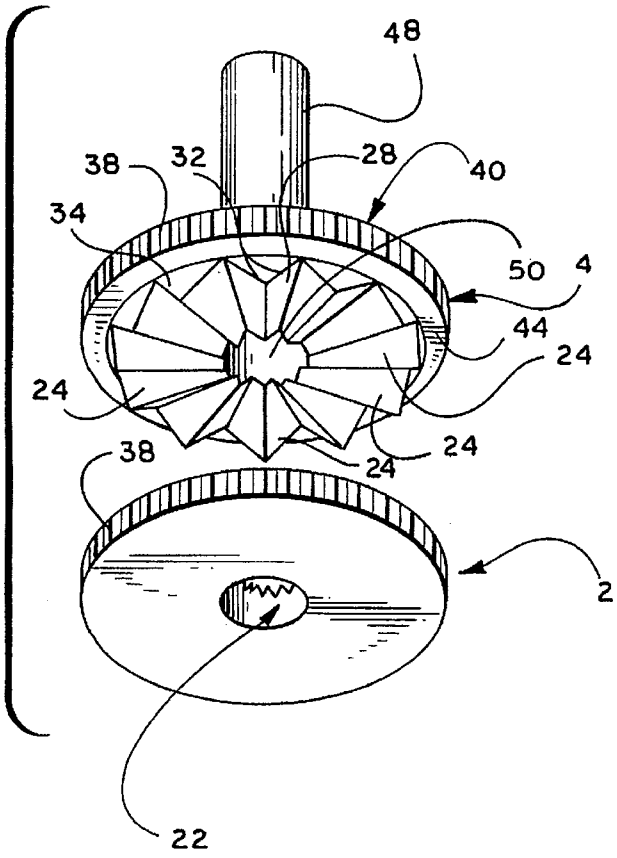
FIG. 1B is an exploded, perspective bottom view of the gears in FIG. 1A.

Referring to the drawings wherein like reference numerals designate corresponding parts throughout the several figures, reference should be made to the following detailed description taken in connection with the accompanying drawings. Referring to the drawings wherein like reference numerals designate corresponding parts throughout the several figures, reference is made first to FIG. 1A. FIG. 1A of the drawings illustrates one embodiment of the invention comprising a drive gear 2, a cylinder gear 4, a leaf spring 6, a rod 8 and a sliding switch 10.

The timepiece herein described has a gear housing (not shown) containing a horometric movement. Any conventional movement is adaptable to this invention and, therefore, is not a part of the invention hereof. A minute hand gear 12, as shown in FIGS. 3B and 3C, is operatively connected to the movement. This connection is conventional and is not a part of the invention hereof. The minute hand gear 12 has a riser 14 extending through the gear housing to a riser end 16. Mounted to the riser end 16 is a minute hand 18, which is visible outside of the gear housing.

The drive gear 2 is also operatively connected to the movement. This connection is accomplished either directly to the movement or through the minute hand gear 12. The drive gear 2 is generally disc-shaped and has an upper surface 20, a bore 22, and a plurality of crown teeth 24, preferably twelve, protruding from the upper surface 20. Each crown tooth 24 has a first side 26, a second side 28, a ridge 30 disposed between the first and second sides 26 and 28. An angle 32 is formed between the first and second sides diverging from the ridge. Preferably, the angle is equal to or greater than ninety degrees. Further, the crown teeth 24 have an outer end 34 and the outer ends 34 are disposed along a circle which is concentric with the bore 22. The ridges 30 of the crown teeth 24 are disposed along the radii of the circle. A drive gear side 36 is provided adjacent the upper surface 20. Protruding from the drive gear side 36 is a plurality of spur teeth 38. The spur teeth 38 are provided to operatively engage the movement.

Figure 1A:
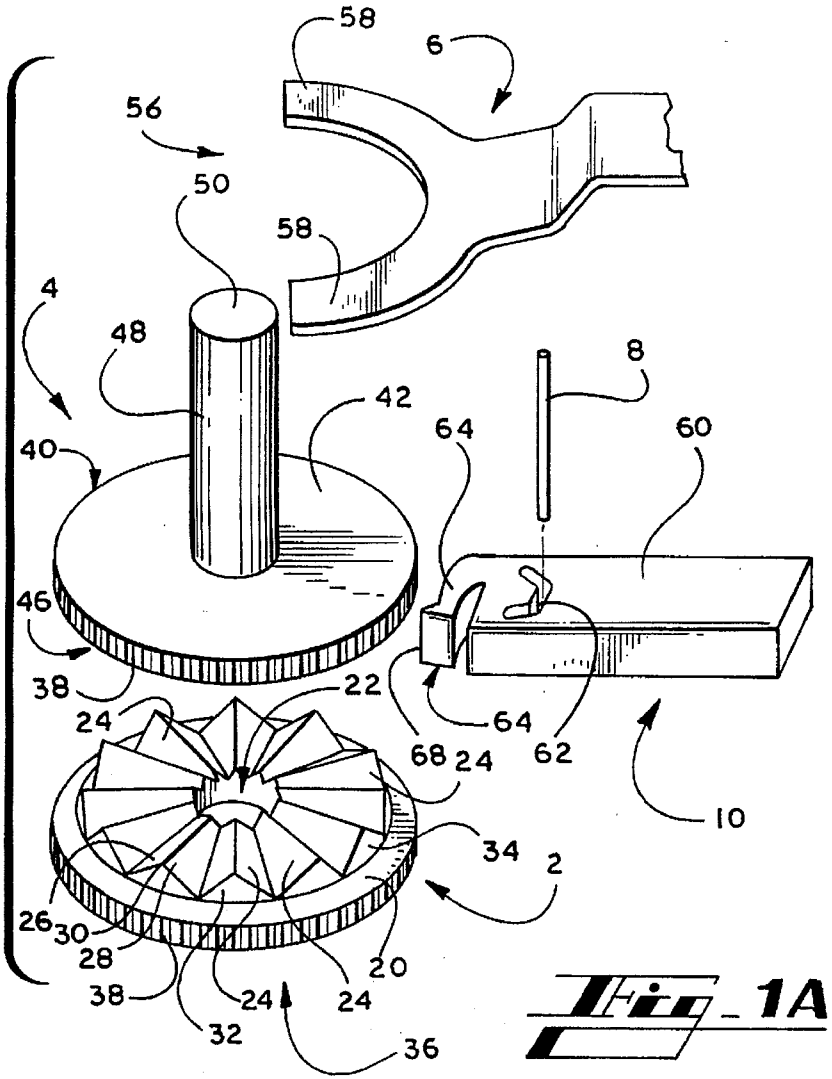
FIG. 1 is an exploded, perspective top view of a drive gear, a cylinder gear, a leaf spring, a rod and a sliding switch.
Figure 2C:
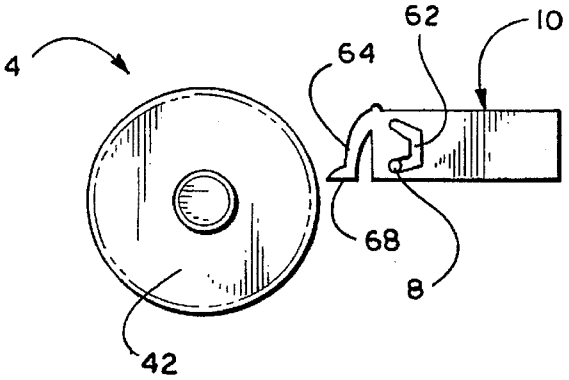
FIG. 2C is a top view of the sliding switch after engaging the cylinder gear.
Figure 2B:
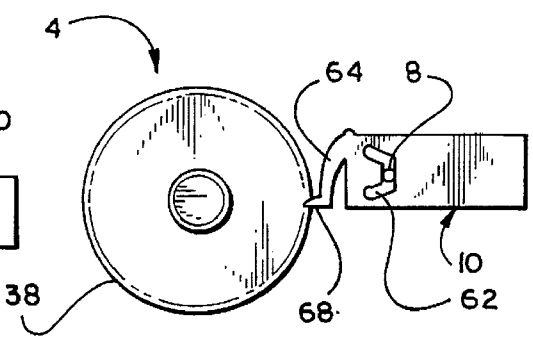
FIG. 2B is a top view of the sliding switch engaging the cylinder gear.
Figure 2A:
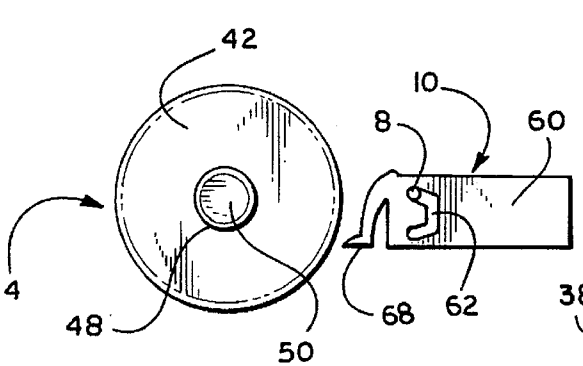
FIG. 2A is a top view of the sliding switch prior to engaging the cylinder gear.
Figure 2F:
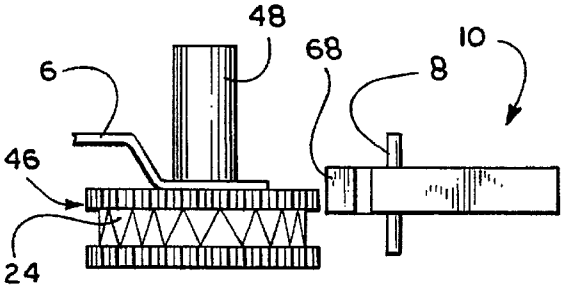
FIG. 2F is a side view of the drive gear, the cylinder gear and the sliding switch after the sliding switch engaged the cylinder gear.
Figure 2E:
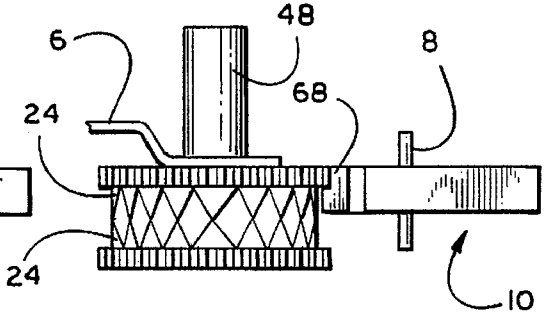
FIG. 2E is a side view of the drive gear, the cylinder gear and the sliding switch while the sliding switch engages the cylinder gear.
Figure 2D:
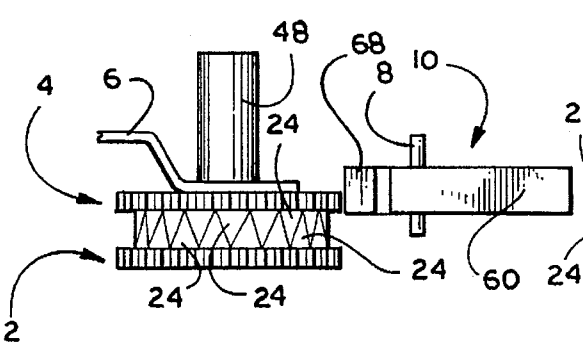
FIG. 2D is a side view of the drive gear, the cylinder gear and the sliding switch prior to the sliding switch engaging the cylinder gear.

The cylinder gear 4 is similarly constructed as the drive gear 2, as additionally shown in FIG. 1B. Two portions comprise the cylinder gear 4. First, a cylinder gear disc 40 portion has a top surface 43, a bottom surface 44 and an edge 46. As with the drive gear, the crown teeth 24 protrude from the bottom surface 44 exactly as the crown teeth 24 protrude from the upper surface 20 of the drive gear 2. Preferably, the shape, number, location and spacing of the crown teeth 24 of the cylinder gear 4 are exact duplicates of the crown teeth 24 of the drive gear 2. This provides the cylinder gear 4 with crown teeth 24 having the same first sides 26, second sides 28, ridges 30, angles 32, and outer ends 34 as the drive gear 2. The circle formed by the outer ends 34 of the crown teeth 24 on the cylinder gear 4 is a duplicate of the circle of the drive gear 2. When the drive gear 2 is coupled to the cylinder gear 4, the crown teeth 24 of both gears 2 and 4 matingly engaged one another and the outer ends 34 of the respective crown teeth 24 abut. Also, the drive gear 2 and the cylinder gear 4 are coaxial while engaged. Along the edge 46 is a plurality of protruding spur teeth 38.

The second portion of the cylinder gear 4 is an hour hand cylinder 48 depending from the cylinder gear disc 40. An opening 50 is provided through the hour hand cylinder 48 and the cylinder gear disc 40. Like the drive gear 2, the circle formed by the outer ends 34 of the crown teeth 24 on the bottom surface 44 is concentric with the opening 50. Extending through the gear housing to a cylinder end 52, the hour hand cylinder 48 has an hour hand 54 mounted to the cylinder end 52, which is likewise visible outside of the gear housing.

The drive gear 2 and the cylinder gear 4 are biased together to operably engage one another. A spring is used as a means to bias the bottom surface 44 of the cylinder gear 4 in contact with the upper surface 20 of the drive gear 2. Various springs can be used, such as a coil spring (not shown), a flat spring engaging the top surface 42 of the cylinder gear 4, or any type of device which can assert pressure upon the top surface 42 of the cylinder gear 4. Any current gear housings already incorporate this spring and will not have to be revised. Preferably, the leaf spring 6 is used. The leaf spring 6 has a mounting end (not shown) mounted to a inner surface of the gear housing and a pressure end 56. At the pressure end 56, the leaf spring 6 has two tines 58 which form the shape of a semi-circle. The tines 58 slidingly engage the top surface 42 of the cylinder gear 4. Although resilient, the tines 58 provide only nominal pressure upon the cylinder gear 4.

In this embodiment, the sliding switch 10 engages the spur teeth 38 of the cylinder gear 4. The sliding switch 10 has a rectangularly-shaped elongate body 60, a flattened V-shaped slot 69 through the body 60, a spring arm 64 pending from the body 60 having a distal end 66, and a switch tooth 68 pending from the spring arm 64 at the distal end 66 to removably engage the spur teeth 38 of the cylinder gear 4. The rod 8 is disposed through the slot 62 and mounted to the gear housing, enabling the sliding switch 10 to pivot about the rod 8.

Referring now to FIGS. 2A through 2F, as the sliding switch 10 pivots about the rod 8, the switch tooth 68 pushes against one of the spur teeth 38 of the cylinder gear 4 and forces the crown teeth 24 of the cylinder gear 4 to slide over the crown teeth 24 of the drive gear 2, moving into an adjacent position. The shape of the slot 62 enables the operator of the sliding switch 10 to gain additional leverage to slide the crown teeth 24 of the cylinder gear 4 from one position to the adjacent position. Because of the gear ratio of the drive gear 2 as compared to the gearing of the movement, minimal force is needed to activate the cylinder gear 4. Since the hour hand 54 is mounted to the cylinder gear 4, the hour hand 54 moves independently of the movement and the minute hand 18. Also, because there are twelve, equidistant crown teeth 24 on each gear 2 and 4, when the crown teeth 24 are moved into the adjacent position, the hour hand 54 rotates 30 degrees and provides a one-hour time indication adjustment.

Figure 3A:
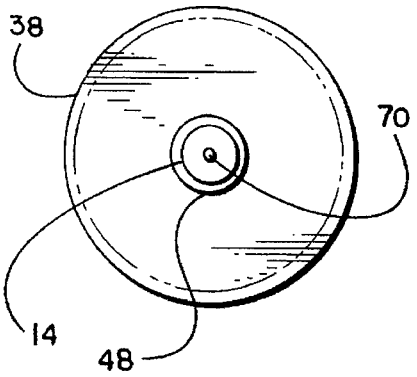
FIG. 3A is a top view of a second hand shaft within a minute hand cylinder which is within a hour hand cylinder.
Figure 3B:
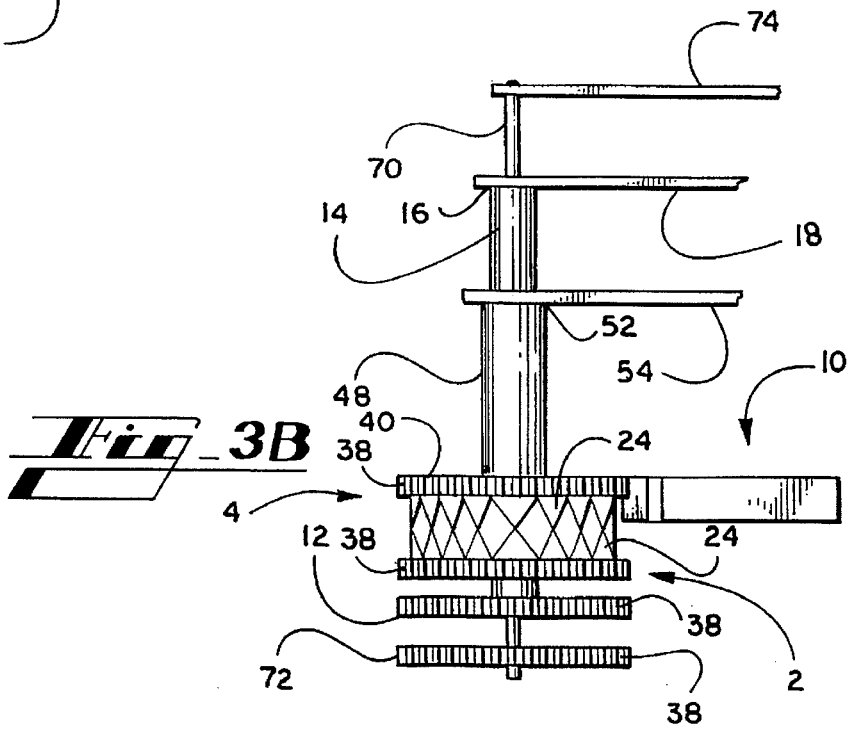
FIG. 3B is a side view of the shaft and cylinders of FIG. 3A with the sliding switch engaging the cylinder gear.
Figure 3C:
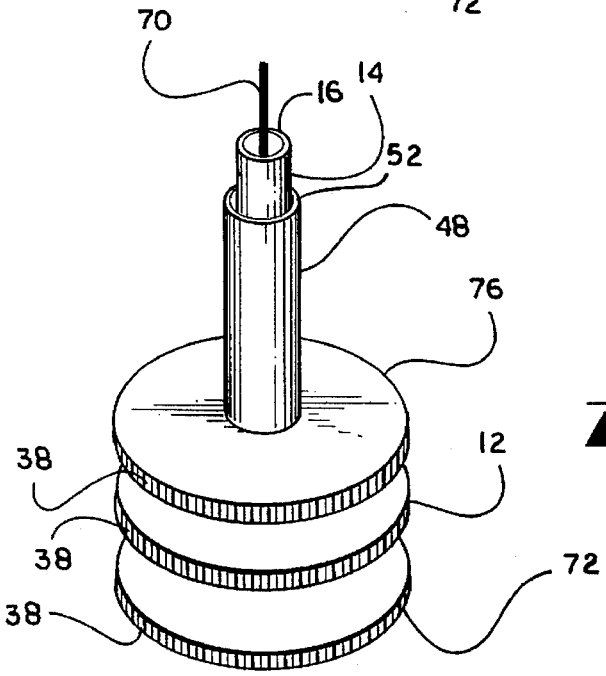
FIG. 3C is a top perspective view of the shaft and cylinders of FIG. 3A in a conventional arrangement.

When assembled, as shown in FIGS. 3A and 3B, the riser 14 of the minute hand gear 12 extends through the bore 22 of the drive gear 2 and the opening 50 of the cylinder gear 4. As assembled, the minute hand gear 12, the drive gear 2 and the cylinder gear 4 are coaxial. Provided the riser 14 is hollow, a shaft 70 of a second hand gear 72, which is operatively connected to the movement, can extend through the riser 14. FIG. 3B shows the shaft 70 having a second hand 74 mounted thereon. Additionally, FIG. 3B shows the sliding switch 10 engaging the cylinder gear 4 without interfering with the action of the minute and second hand gears 12 and 74.

FIG. 3C shows an arrangement of a conventional analog clock having a conventional hour hand cylinder gear 76 with spur teeth 38. The principle difference between the conventional arrangement and the present invention is that the drive gear 2 and the cylinder gear 4 replace the conventional hour hand cylinder gear 76. Since the drive gear 2 is designed to duplicate the conventional hour hand cylinder gear 76 in size and spur teeth 38 arrangement, the time keeping function of the clock is unaffected.

Figure 4:
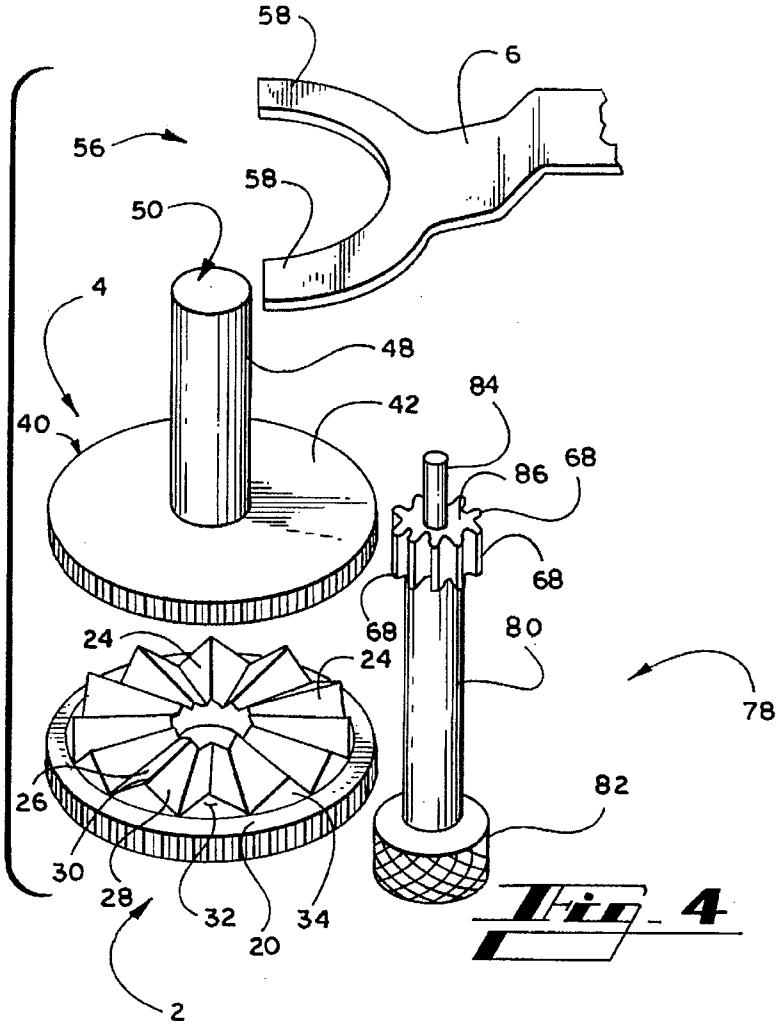
FIG. 4 is an exploded, perspective top view of the drive gear, the cylinder gear, the leaf spring and a spindle switch.

Another embodiment of the invention, as shown in FIG. 4, has a spindle switch 78 replacing the rod 8 and the sliding switch 10. The spindle switch 78 comprises a staff 80 having opposite ends. At one end of the staff 80 is a knob 82 for turning the spindle switch 78. A pin 84 pends from the staff 80 at the other end and is rotatably mounted to the gear housing. Proximate the pin 84 is a circumferential body 86 having a plurality of switch teeth 70. The switch teeth 70 engage the spur teeth 38 of the cylinder gear 4.

Figure 5:
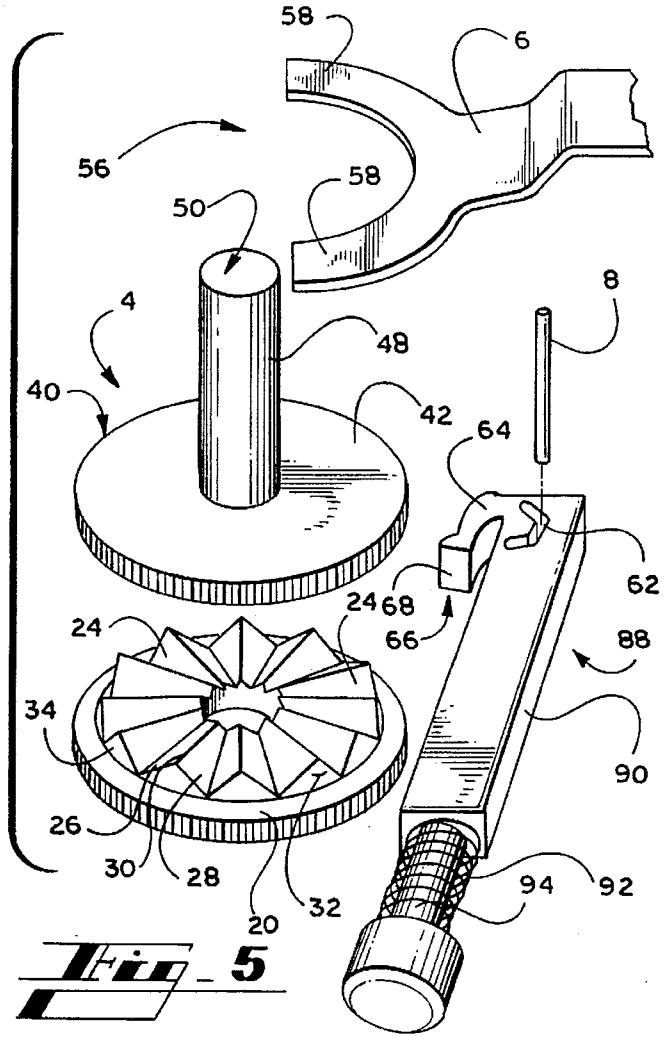
FIG. 5 is an exploded, perspective top view of the drive gear, the cylinder gear, the leaf spring and a pop-up switch.

Yet another embodiment of the invention, as shown in FIG. 5, has a pop-up switch 88. The pop-up switch 88 replaces the sliding switch 10 of the first embodiment. Comprising the pop-up switch 88 is an arm housing 90, a coil-spring 92 activated pop-up arm 94, the spring arm 66 pending from the arm housing 90 having the distal end 68, the switch tooth 70 at the distal end 68, the slot 64 through the arm housing 90 and the rod disposed through the slot 64 and mounted to the gear housing. The pop-up switch 88 is utilized in the same manner as the sliding switch 10.

The number of crown teeth 24 varying is envisioned, however, the accuracy and the ease of use may be compromised.

Various modifications may be made of the invention without departing from the scope thereof and it is desired, therefore, that only such limitations shall be placed thereon as are imposed by the prior art and which are set forth in the appended claims.

What is claimed is:

1. An analog timepiece, comprising:

a gear housing;

a horometric movement disposed within the gear housing;

a minute hand gear operatively connected to the movement, the minute hand gear having a minute hand thereon visible outside the gear housing;

a drive gear operatively connected to the movement, the drive gear having an upper surface;

a cylinder gear operatively engaging the drive gear, the cylinder gear having a bottom surface, an edge and an hour hand thereon visible outside the gear housing, the edge having a plurality of protruding spur teeth;

a plurality of crown teeth protruding from both the upper surface of the drive gear and the bottom surface of the cylinder gear, the crown teeth of the cylinder gear matingly engaging the crown teeth of the drive gear;

a first means for biasing the cylinder gear in contact with the drive gear;

at least one switch tooth removably engaging the spur teeth of the cylinder gear, forcing the crown teeth of the cylinder gear to slide over the crown teeth of the drive gear and causing the hour hand to move independently of the horometric movement and the minute hand; and a second means for activating the switch tooth to removably engage the spur teeth of the cylinder gear.

2. A timepiece as claimed in claim 1, wherein the cylinder gear has a top surface, the gear housing has an inner surface and the first means is a spring having two ends engaging the inner surface at one end and slidingly engaging the top surface at the other end.

3. A timepiece as claimed in claim 2, wherein the spring is a leaf spring.

4. A timepiece as claimed in claim 1, wherein the second means comprises:

a sliding switch having a body, a slot through the body, a spring arm pending from the body having a distal end, and the switch tooth pending from the spring arm at the distal end; and a rod disposed through the slot and mounted to the gear housing so that the sliding switch pivots about the rod.

5. A timepiece as claimed in claim 1, wherein the second means comprises a spindle switch having a staff, a pin pending from the staff and rotatably mounted to the gear housing, and a plurality of switch teeth pending from the staff.

6. A timepiece as claimed in claim 1, wherein the second means comprises:

a pop-up switch having an arm housing, a coil-spring activated pop-up arm protruding from the arm housing, a slot through the arm housing, a spring arm pending from the arm housing having a distal end, and the switch tooth pending from the spring arm at the distal end; and a rod disposed through the slot and mounted to the gear housing so that the sliding switch pivots about the rod.

7. A timepiece as claimed in claim 1, wherein the crown teeth have a first side, a second side, a ridge disposed between the first and second sides and an angle formed between the first and second sides diverging from the ridge.

8. A timepiece as claimed in claim 7, wherein the angle is at least a ninety degree angle.

9. A timepiece as claimed in claim 7, wherein each of the crown teeth have an outer end and the outer ends are disposed along a circle.

10. A timepiece as claimed in claim 9, wherein the ridges of the crown teeth are disposed along the radii of the circle.

11. A timepiece as claimed in claim 10, wherein the drive gear and the cylinder gear each have twelve equidistantly-spaced crown teeth.

12. A timepiece as claimed in claim 1, wherein the diameter of the cylinder gear bottom surface is greater than the diameter of the drive gear top surface.

13. A timepiece as claimed in claim 1, wherein the drive gear and the cylinder gear are coaxial.

14. A timepiece as claimed in claim 1, wherein the minute hand gear has a riser, the drive gear has a bore and the riser extends through the bore, the cylinder gear has a hour hand cylinder, the hour hand cylinder has an opening and the riser extends through the opening, and the minute hand gear, the drive gear and the cylinder gear are coaxial.

15. An analog timepiece, comprising:

a gear housing having an inner surface;

a horometric movement disposed within the gear housing;

a minute hand gear operatively connected to the movement, the minute hand gear having a riser and a minute hand mounted to the riser visible outside the gear housing;

a drive gear operatively connected to the movement, the drive gear having an upper surface and a bore, the riser extending through the bore;

a cylinder gear operatively engaging the drive gear, the cylinder gear having a top surface, a bottom surface, an edge, an hour hand cylinder and an hour hand mounted to the hour hand cylinder visible outside the gear housing, the edge having a plurality of protruding spur teeth, the minute hand gear, the drive gear and the cylinder gear being coaxial;

twelve equidistantly spaced crown teeth protruding from both the upper surface of the drive gear and the bottom surface of the cylinder gear, the twelve crown teeth of the cylinder gear matingly engaging the twelve crown teeth of the drive gear, the crown teeth having a first side, a second side, a ridge disposed between the first and second sides and at least a ninety degree angle formed between the first and second sides diverging from the ridge, the crown teeth having an outer end and the outer ends being disposed along a circle, the ridges of the crown teeth being disposed along the radii of the circle;

a leaf spring to bias the cylinder gear in contact with the drive gear, the leaf spring having two ends, one end engaging the inner surface and the other end slidingly engaging the top surface;

a switch tooth removably engaging the spur teeth of the cylinder gear, forcing the crown teeth of the cylinder gear to slide over the crown teeth of the drive gear and causing the hour hand to move independently of the horometric movement and the minute hand;

a sliding switch to activate the switch tooth to removably engage the spur teeth of the cylinder gear, the sliding switch having a body, a slot through the body, a spring arm pending from the body having a distal end, and the switch tooth pending from the spring arm at the distal end; and a rod disposed through the slot and mounted to the gear housing so that the sliding switch pivots about the rod.

* * * * *